US005231420A

United States Patent [19]

Yamamoto et al.

[11] Patent Number: 5,231,420

[45] Date of Patent: Jul. 27, 1993

[54] THERMAL PRINT HEAD

[75] Inventors: Yoshikatsu Yamamoto; Yoshinao Miyata; Toshio Narita, all of Nagano, Japan

[73] Assignee: Seiko Epson Corporation, Tokyo, Japan

[21] Appl. No.: 514,223

[22] Filed: Apr. 25, 1990

[30] Foreign Application Priority Data

| | | | |
|---|---|---|---|
| Apr. 26, 1989 | [JP] | Japan | 1-106403 |
| Dec. 18, 1989 | [JP] | Japan | 1-327626 |
| Dec. 28, 1989 | [JP] | Japan | 1-340717 |

[51] Int. Cl.[5] ..... B41J 2/325

[52] U.S. Cl. ..... 346/76 PH; 29/611; 29/620; 29/621

[58] Field of Search ..... 346/76 PH; 29/611, 620, 29/621; 427/289, 290, 402

[56] References Cited

U.S. PATENT DOCUMENTS

| | | | |
|---|---|---|---|
| 4,630,073 | 12/1986 | Hashimoto | 346/76 PH |
| 4,651,168 | 3/1987 | Terajima et al. | 346/76 PH |
| 4,701,593 | 10/1987 | Hiramatsu | 346/76 PH |
| 4,795,887 | 1/1989 | Myokan | 346/76 PH |
| 4,944,983 | 7/1990 | Nonoyama et al. | 346/76 PH |
| 4,968,996 | 11/1990 | Ebihara et al. | 346/76 PH |
| 4,973,986 | 11/1990 | Narita | 346/76 PH |

FOREIGN PATENT DOCUMENTS

| | | | |
|---|---|---|---|
| 0251036 | 1/1988 | European Pat. Off. . | |
| 3702849 | 8/1988 | Fed. Rep. of Germany . | |
| 0053062 | 3/1986 | Japan | 346/76 PH |
| 61-290068 | 12/1986 | Japan . | |
| 0111765 | 5/1987 | Japan | 346/76 PH |
| 0116166 | 5/1987 | Japan | 346/76 PH |
| 0061265 | 3/1989 | Japan | 346/76 PH |

*Primary Examiner*—Benjamin R. Fuller
*Assistant Examiner*—Huan Tran
*Attorney, Agent, or Firm*—Cushman, Darby & Cushman

[57] ABSTRACT

A thermal print head comprises: a thermally resistant insulating substrate; a glazed glass partially formed on the substrate at one end side thereof; a heating element formed on the glazed glass; a first common electrode formed on the heating element; and a protective film formed on the first electrode; a second common electrode a part of which is formed between the insulating substrate and the glazed glass, the first and second electrodes being connected to each other; wherein the insulating substrate has a chamfer on the one end side where the first and second common electrodes are arranged, the chamfer being formed closely from the glazed glass, a part of the first and second common electrode being arranged on the chamfer.

1 Claim, 6 Drawing Sheets

THERMAL PRINT HEAD

BACKGROUND OF THE INVENTION

1. Field of the Invention

This invention relates to a thermal print head for use in thermal printers and facsimile machines.

2. Prior Art

There is a tendency that a number of recently developed thermal print heads have their partially glazed glass with a heating element arranged toward an end face of a print head substrate, irrespective of the type of printer, serial or line, to improve the printing quality. This is because the arrangement that the head is inclined at a certain angle with respect to the sheet surface enables not only the ink ribbon peeling angle to be larger but also the head pressing force to be focused, thereby improving the printing quality. For this reason, the conventional thermal print head has been arranged as shown in FIGS. 1(*a*) and 1(*b*). That is, in FIG. 1(*a*), numeral reference 1 designates a thermally resistant insulating substrate, and numeral reference 2 designates a partially glazed glass made of glass material formed on the insulating substrate. A heating element 3 is arranged on the partially glazed glass 2. Further, a thin film common electrode 5 and an individual electrode 6 are formed on the heating element 3 so as to provide a predetermined space therebetween on a top of the glazed glass 2, and to make part B of the thin film common electrode 5 as small as possible. A protective film 7 is also formed on the heating element 3 through the thin film common electrode 5 and the individual electrode 6. A heating action as a thermal head is conducted through a heating element section 60 which is defined by the predetermined space between the thin film common electrode and the individual electrode. A thermal head as shown in FIG. 1(*b*) is fundamentally the same in construction as that of FIG. 1(*a*). However, in FIG. 1(*b*), a thick film common electrode 8 is arranged on the end and rear surface of the substrate 1 to ensure the adequate current capacity of the thin film common electrode 5 whose size is reduced.

However, since arrangement of the partially glazed glass 2 toward the end face of the substrate necessarily causes the heating element 3 to come closer to the end face of the substrate, the space for the thin film common electrode is reduced, thereby entailing the following problems.

(1) The current capacity of the thin film common electrode is decreased, so that when a number of dots are energized concurrently, a voltage drop occurs, thereby reducing the printing density.

(2) The utilization of the end face and rear surface as the common electrodes as shown in FIG. 1(*b*) will increase the cost of manufacturing the head.

(3) In the embodiments of FIGS. 1 (*a*) and 1 (*b*), at least a distance of 200 to 300 μm is required between the edge of the head substrate and that of the partially glazed glass. This means that the more the number of dots is arranged on the head, the more it is difficult to near the glazed glass to the end face of the head.

In an attempt to overcome the above problems, a method has been disclosed in Japanese Patent Application No. 132580/1985.

The above patent application proposes a head whose structure is fundamentally the same as that of FIG. 1(*b*), as shown in FIG. 2. In FIG. 2, a thick film common electrode 4 is arranged under the partially glazed glass 2, that is, between the glazed glass 2 and the substrate 1. This is to increase the current capacity of the thick film common electrode 4, thereby contributing to appreciably improving the above problems (1) to (3). However, to provide larger angles of inclination of the head and of peeling of the ink ribbon, it is necessary to make the distance between the edge of the partially glazed glass 2 and that of the substrate 1, which is still 50 to 100 μm, smaller.

To manufacture the conventional end face type thermal print head, a method shown in FIG. 3 has been known. In this method, one end of the substrate 1 is provided with a partially glazed glass 2; and the heating element 3 is arranged on the partially glazed glass 2; and the substrate 1 is cut.

However, such method of fabricating a thermal head by forming the partially glazed glass on the end face of the substrate in this way has a limit in that it can provide a maximum of only two lines of head a substrate for the serial printer and only two chips of head for the line printer, thereby raising the manufacturing cost.

SUMMARY OF THE INVENTION

An object of the present invention is therefore to overcome the above conventional problems and thereby to provide a thermal print head having larger angles of inclination of the head and of peeling of the ink ribbon.

Another object of the present invention is to provide a thermal print head both capable of accommodating an increase printing angle and using a partially glazed glass that has a proper thermal property.

Still another object of the present invention is to provide an inexpensive thermal print head with a satisfactory printing quality by stably preparing a partially glazed glass whose radius of curvature is smaller thereby to allow the printing pressure to be focused.

The thermal print head according to the present invention comprises a thermally resistant insulating substrate and a partially glazed glass that is arranged on the thermally resistant insulating substrate, and at least includes a heating element, a common electrode, an individual electrode, and a protective film. The heating element is disposed on the partially glazed glass and part of the common electrode is arranged under the partially glazed glass. The side of the thermally resistant insulating substrate in which a common electrode will be formed is chamfered closely from the partially glazed glass and part of the common electrode is formed on the chamfered portion of the partially glazed glass.

Further, the thermal print head according to the present invention, which includes the partially glazed glass formed on the substrate and the heating element arranged on the partially glazed glass, has at least one end of the substrate chamfered; the partially glazed glass formed adjacent to the chamfered portion of the substrate; and a thick film common electrode arranged on the chamfered portion by thick film printing.

Still further, the thermal print head according to the present invention, which includes a thermally resistant insulating substrate, a partially glazed glass arranged on the thermally resistant insulating substrate, and a heating element section formed on the partially glazed glass, has: an inclined surface formed on at least one end of the substrate; the partially glazed glass formed so that it will extend over the boundary section between the inclined surface and the film forming surface of the substrate; and the heating element section arranged so that it will be adjacent to or, preferably, extent over, the boundary section between the inclined surface and the film forming surface of the substrate.

Still further, the thermal print head according to the present invention is provided with a grooved portion on the substrate, and the partially glazed glass and the heating element section are arranged symmetrically on the groove faces respectively.

DETAILED DESCRIPTION OF THE PREFERRED EMBODIMENTS

Figure 4:
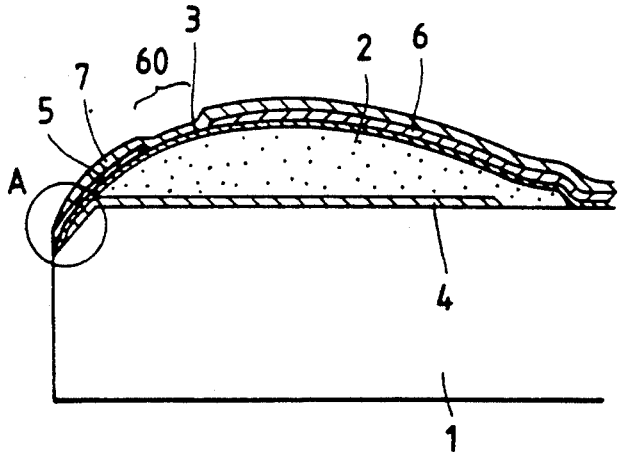
FIG. 4 is a sectional view showing the vicinity of a heating element section of a thermal print head that is a first embodiment of the present invention.

FIG. 4 is a sectional view showing an example of the structure around a heating element section of the thermal print head that is a first embodiment of the present invention. A partially glazed glass 2 is arranged on a thermally resistant insulating substrate 1, and a heating element 3 is arranged on the partially glazed glass 2. The thermally resistant insulating board 1 is chamfered from the edge of the partially glazed glass 2. A thick film common electrode 4, formed of an electrically conductive film, is formed under the partially glazed glass 2 and is connected to a thin film common electrode 5, formed of an electrically conductive film, that comes over the thick film common electrode 4 at section A. A protective film 7 is arranged on the heating element through the thin film common electrode 5 and an individual electrode 6.

Figure 5:
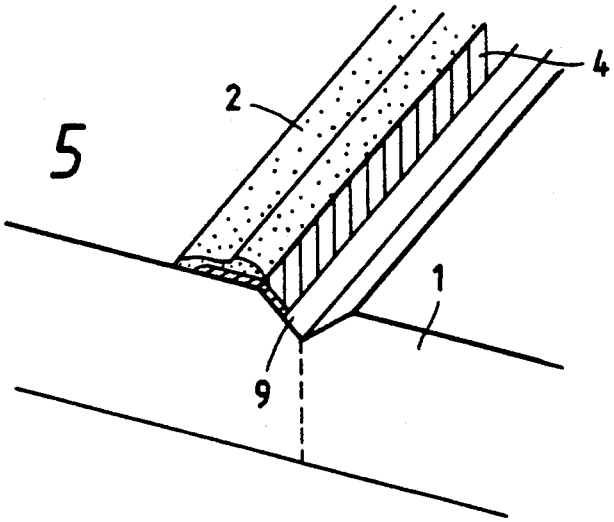
FIG. 5 is a diagram showing the state of having burned a partially glazed glass.

This thermal print head is fabricated as follows. As shown in FIG. 5, a green sheet of insulating substrate made of alumina or the like is subjected first to a dicing process to form a V-shaped groove 9 and then burned; or first the green sheet is burned and then the V-shaped groove 9 is formed by a dicing saw or the like. This V-shaped groove 9 will form a chamfered portion for arranging the common electrodes. In this embodiment the angle of inclination of the head with respect to the horizontal plane is 45°.

Then, a metal paste of Au or Ag/Pt material is screen-printed so that it will cover part of the V-shaped groove 9. It is preferable that the metal paste should have a high burning temperature; however, that the burning temperature of the partially glazed glass was higher than that of the metal paste is one of the reasons why this type of method has been unapplicable though proposed. In the present invention, an Au paste whose burning temperature is 870° to 880° C. was used. The width and thickness of the thick film common electrode 4 must be adjusted depending on the density of dot of the thermal print head and the number of dots employed for printing.

The partially glazed glass 2 is burned at a temperature range of 850°±10° C., which is slightly lower than the burning temperature of the metal paste. The substrate 1 thus fabricated is subjected to a process using a vacuum thin film deposition system such as a sputtering system thereby to form a heating element layer and electrode layers. Thereafter, the heating element and the electrodes are formed by a generally known photolithographic method. The protective film is deposited by some deposition method such as sputtering, chemical vapor deposition, or ion plating.

Experiments were conducted using the thermal print head thus obtained. In the experiments, the standard heads of 960 dots and 300 dpi were used. The maximum settable angle of inclination of a nonchamfered head was about 10°, whereas the set angle of inclination of a chamfered head was about 20°. Using a kind of paper generally called "rough paper" such as XEROX 4024 and Lancaster Bond, the printing quality was compared between the two types of heads, the result of which is as indicated in Table 1.

TABLE 1

| Transferred paper | Head | |
|---|---|---|
| | chamfered | nonchamfered |
| XEROX 4042 | ○ | Δ |
| Lancaster Bond | Δ | X |

○: satisfactory
Δ: less satisfactory
X: defective

As shown in Table 1, there is a distinctive difference between these heads in the printing quality, and it has been evidenced that both heads are adapted to printing on the rough paper.

A second embodiment will be described. The same reference numbers designate the same parts and components in the first embodiment. In the thermal print head of the first embodiment, arrangement of the partially glazed glass comes after the thick film common electrode has been arranged. Since it is not allowed to raise the temperature in burning the partially glazed glass, a kind of glass whose thermal property is restricted must be used.

To this end, in the thermal print head of the second embodiment, a chamfered portion 40 is arranged on one end of the substrate 1 and a partially glazed glass 2 is formed adjacent to the chamfered portion to allow the use of a glass whose thermal property is not restricted. Further, a thick film common electrode 4 is arranged at least on the chamfered portion 40 by thick film printing so that one end of the thick film common electrode is adjacent to the partially glazed glass.

The second embodiment will be described with reference to the accompanying drawings. The thermal print head of the second embodiment is applicable to both serial and line printers. The thick film common electrode arranged by thick film printing may be composed of various materials including Au and Ag-Pd.

The experiments were conducted on the following points: (1) maximum printing angle; (2) reduction ratio between the peak temperature when all the dots are energized with respect to the peak temperature when a single dot is energized (hereinafter referred simply to "peak temperature reduction ratio") to evaluate the current capacity of the thick film common electrode; and (3) step-up stress test (SST) to evaluate the thermal property of the partially glazed glass.

The peak temperature reduction ratio of item (2) will be explained. The thermal print head has two types of electrode: individual electrodes, each of which is connected to each heating elements and a common electrode that is connected to all the heating elements in common. These two types of electrode maintain an equal potential (high) in the stand-by condition (non-printing condition), while in the printing condition, the individual electrodes are grounded, and current flows from the common electrode to the individual electrodes through the heating elements. For instance, only one of the dots, whose resistance is R, is energized. If it is supposed that when the energy for obtaining a required peak temperature is $\epsilon$ (mj), its pulse duration is t, the current i is expressed as follows.

$$i=\sqrt{\{\epsilon / (Rt)\}}$$

If the resistance of the common electrode is Rc, the voltage drop at the common electrode V is expressed as follows.

$$V=i\,Rc=Rc\sqrt{\{\epsilon / (Rt)\}}$$

Therefore, when more dots are energized, the voltage drop increases in proportion to the number of dots energized, thereby reducing the voltage actually applied to the heating elements. As a result, there is a difference in the temperature of the heating element section between the time of energizing only one dot and the time of energizing many dots.

Figure 7A:
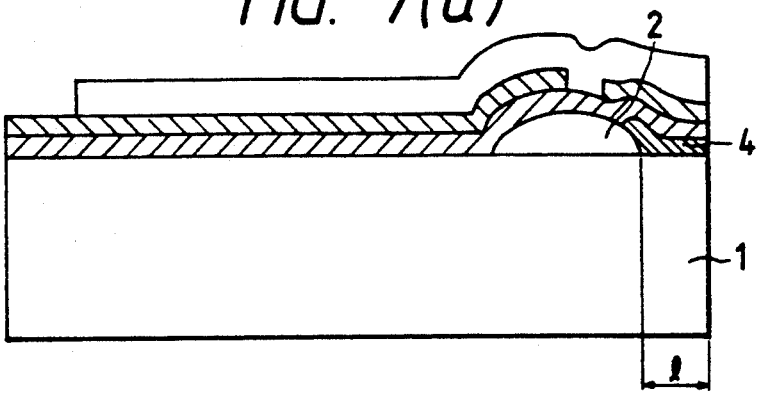
FIGS. 7(*a*) and (*b*) are sectional views respectively showing a thermal print head of a comparative example.
Figure 7B:
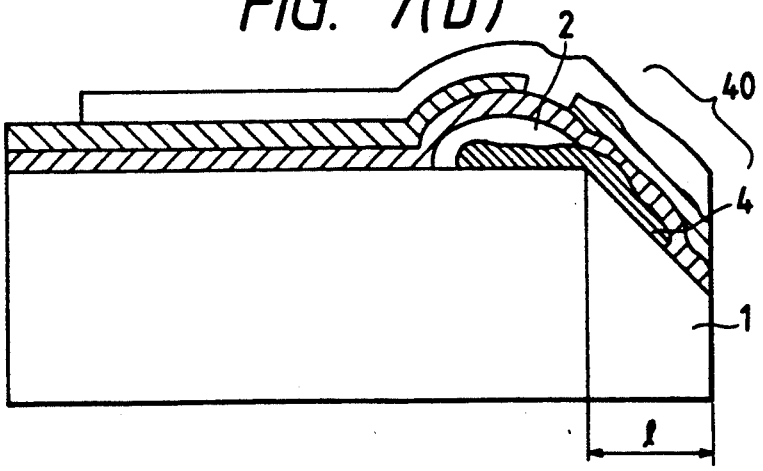

The thermal print heads shown in FIGS. 7 (*a*) and 7 (*b*) will be used as the comparative examples.

Figure 6:
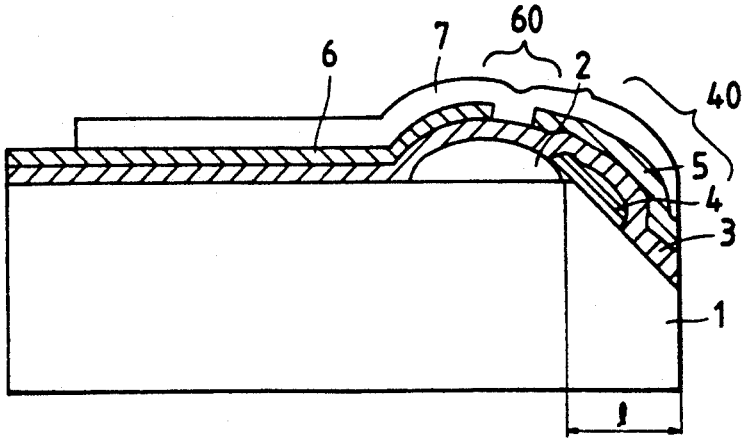
FIG. 6 is a sectional view of a thermal print head that is a second embodiment of the present invention.

The samples used are:

(1) One in which the distance l shown in FIG. 6 is varied within the range of 100 to 800 μm.

(2) One in which the distance l shown in FIG. 7 (*a*) is varied within the range of 100 to 800 μm.

(3) One in which the distance l shown in FIG. 7 (*b*) is varied within the range of 100 to 800 μm.

Figure 8:
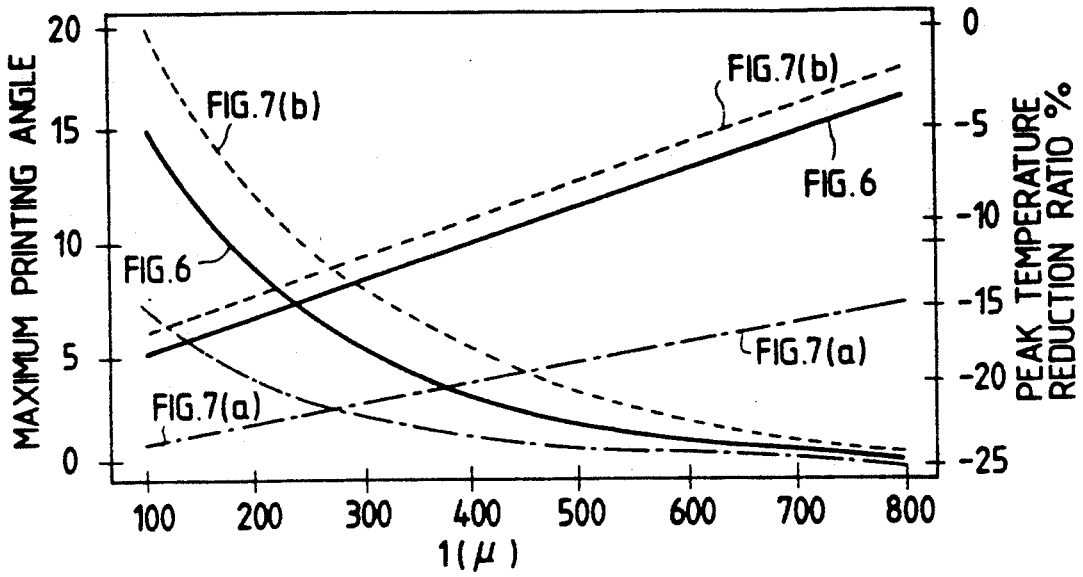
FIG. 8 is a diagram showing the relationship between the maximum printing angle and the peak temperature reduction ratio when the distance on the common electrode forming side is changed for respective types of printer.

FIG. 8 shows a diagram in which the maximum printing angle with respect to 1 and peak temperature reduction ratio of each sample are plotted.

It is found that in the thermal print head shown in FIG. 7 (*a*), it is difficult to increase the printing angle, and its peak temperature reduction ratio is large. On the other hand, the thermal print head shown in FIG. 7 (*b*) has a larger current capacity because of the larger area of the thick film common electrode under the partially glazed glass, thereby making it possible to bring its peak temperature reduction ratio to zero. Its printing angle is also adequate. Although inferior to the thermal print head shown in FIG. 7 (*b*) in both printing angle and temperature reduction ratio, the thermal print head shown in FIG. 7 (*a*) will likewise possibly be able to make a satisfactory print head.

Figure 9:
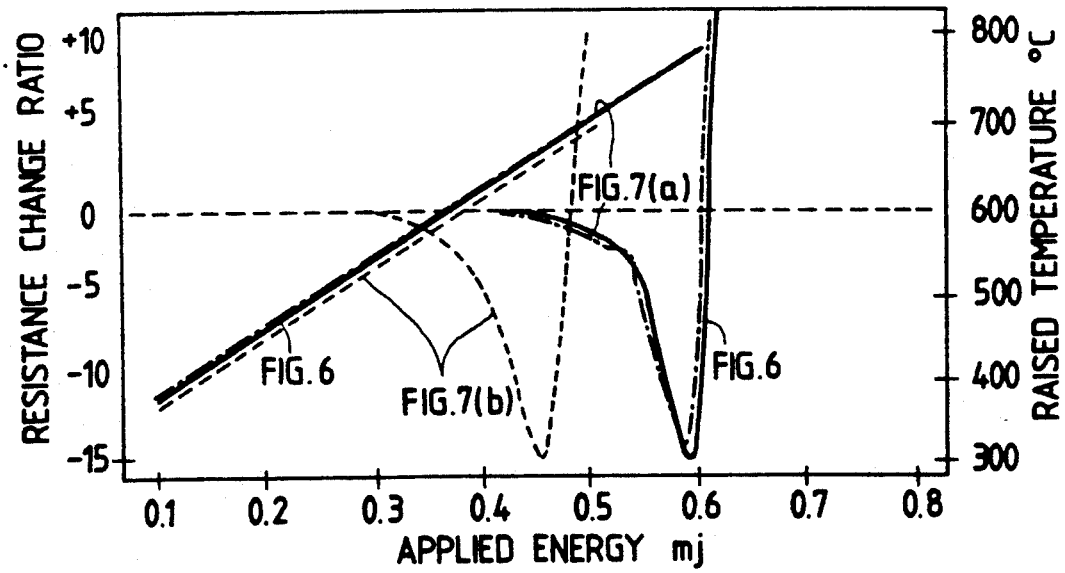
FIG. 9 is a diagram showing the result of an SST test for respective types of printer.

FIG. 9 shows SST data of each sample under l=200 μm. Although no distinctive difference is observed in the raised temperature with respect to the applied energy among the thermal print heads shown in FIGS. 6, 7 (*a*), and 7 (*b*), the change in resistance change ratio with respect to the applied energy is evidenced first by the thermal print head shown in FIG. 7 (*b*). This means that the partially glazed glass of this thermal print head is inferior in thermal property.

Figure 10:
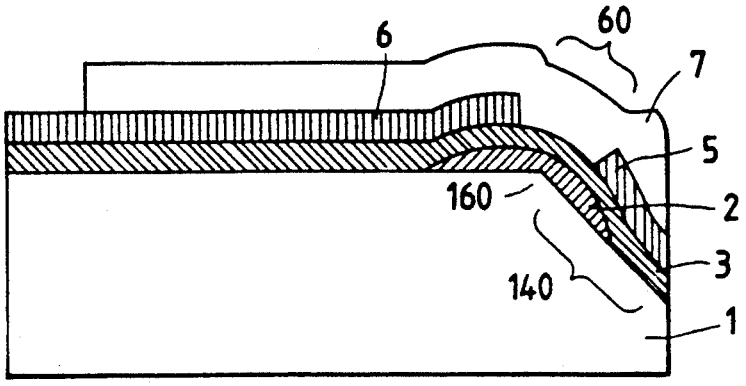
FIG. 10 a sectional view showing a thermal print head that is a third embodiment of the present invention.

As a third embodiment of the present invention, FIG. 10 shows a thermal print head, in which an inclined portion 140 is arranged on one end of the thermally resistant insulating substrate 1; a partially glazed glass 2 is formed on the boundary section between the inclined portion 140 and the film forming surface of the substrate; and a heating element section 60 is arranged adjacent to the boundary section 160 or, preferably, so as to cover part of the boundary section 160.

Figure 11:
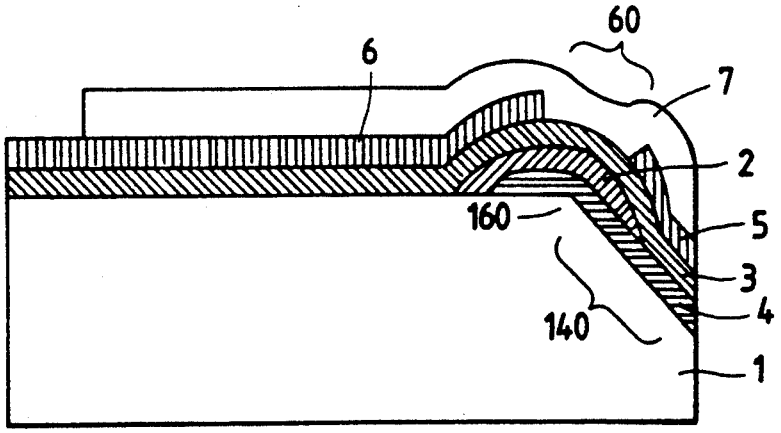
FIG. 11 is a sectional view showing an example in which a thick film common electrode is arranged under a partially glazed glass of the thermal print head that is the third embodiment of the present invention.

Further, as shown in FIG. 11, the thermal print head of this embodiment allows a thick film common electrode 4 to be formed either under or adjacent to the partially glazed glass 2, and it is desirable to do so to decrease the resistance of the thin film common electrode 5.

The embodiments of the present invention will be further described in comparison with the conventional example. The thermal print heads of the present invention are applicable irrespective of the type of printer, serial or line.

Figure 1A:
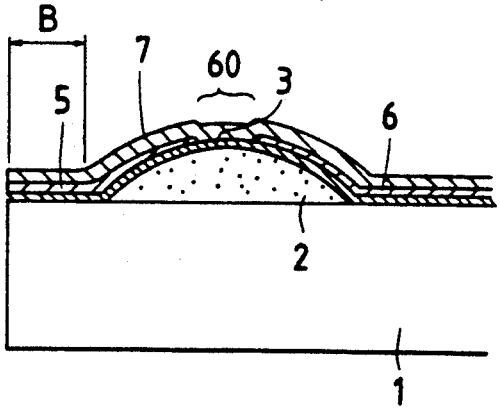
FIGS. 1(*a*) and (*b*) are sectional views respectively showing the vicinity of a heating element section of a conventional thermal print head.
Figure 1B:
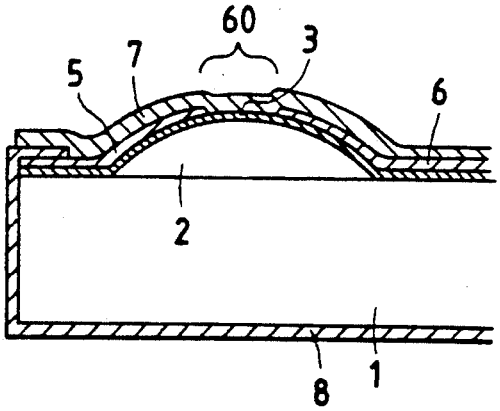
Figure 2:
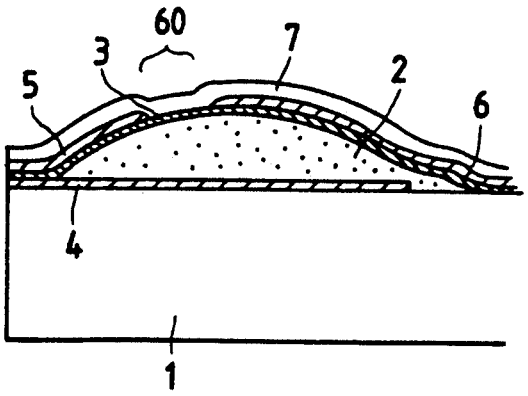
FIG. 2 is a sectional view showing a conventional modified head.
Figure 3:
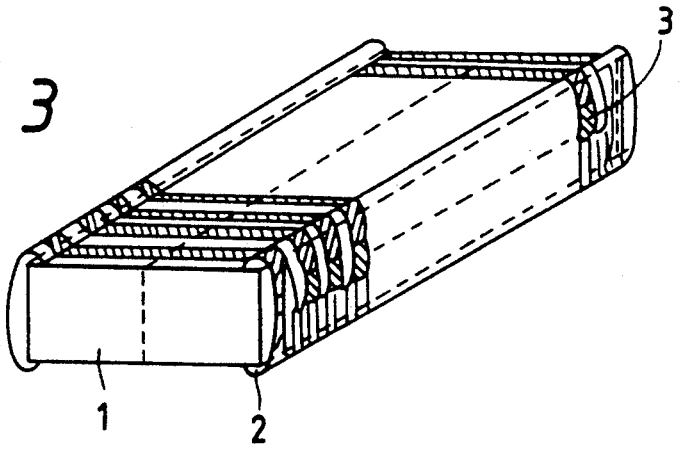
FIG. 3 is a perspective view showing the method of manufacturing a conventional end face type thermal print head.

The samples of the thermal print heads, in which:

the heating element 3 is formed toward the edge of the partially glazed glass 2 as much as possible; i.e., at the smallest part of the radius of curvature of the partially glazed glass as shown in FIGS. 1 (*a*) and 4;

an inclined section is formed on one end of the substrate and the heating element section 60 is arranged on the boundary section 160 as shown in FIG. 10; and a thick film common electrode 4 is formed under the partially glazed glass by thick film printing, and the heating element section 60 is arranged on the boundary section 160 as shown in FIG. 11, are subjected to the following evaluations.

(I) Printing quality; and (II) Peak temperature reduction ratio.

The printing quality listed in item (I) was evaluated by comparing the count of misprints using the generally called "rough paper." The peak temperature reduction ratio listed in item (II) was evaluated in the manner described for the second embodiment.

The evaluation results of items (I) and (II) are as indicated in Table 2.

TABLE 2

| Type of thermal print head | Printing quality | Peak temperature reduction ratio |
|---|---|---|
| Shown in FIG. 10 | ○ | Δ |
| Shown in FIG. 11 | ○ | ○ |
| Shown in FIG. 1 (a) | X | X |
| Shown in FIG. 4 | Δ | ○ |

In evaluating the printing quality it is found that the thermal print head shown in FIG. 1 (*a*) misprints most, while that shown in FIG. 4 misprints much less. The thermal print heads shown in FIGS. 10 and 11 seldom misprint. The thermal print head shown in FIG. 10 is superior to that shown in FIG. 1 (*a*) in peak temperature reduction ratio, because its common electrode is so extended to the inclined surface that its common electrode has a wider area than the common electrode of FIG. 1 (*a*).

Figure 12:
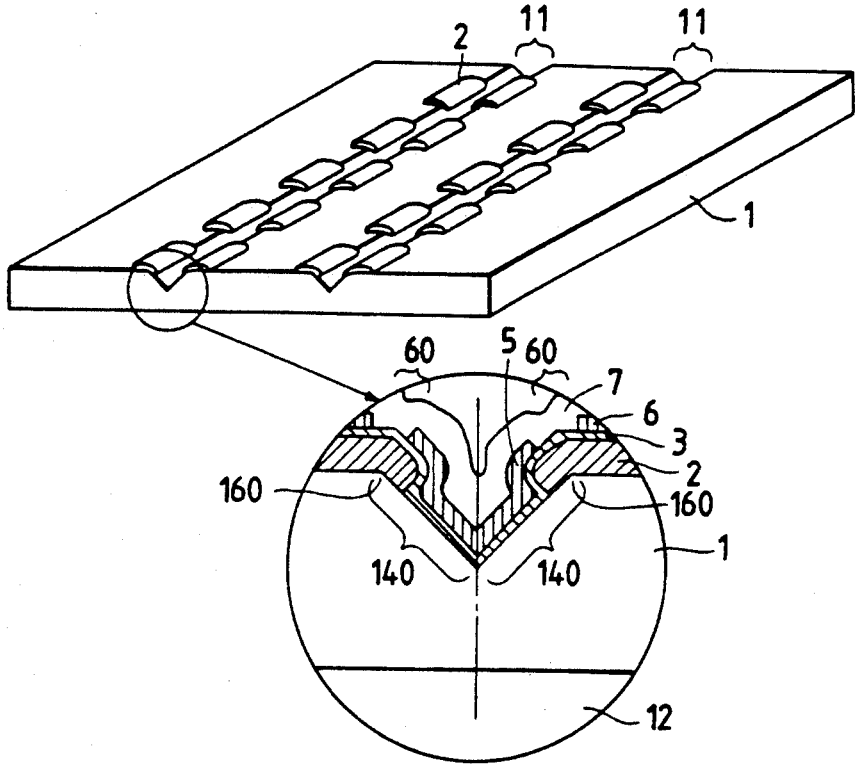
FIGS. 12 and 13 are perspective views and enlarged sectional views showing a method of manufacturing a thermal print head according to the present invention, respectively.
Figure 13:
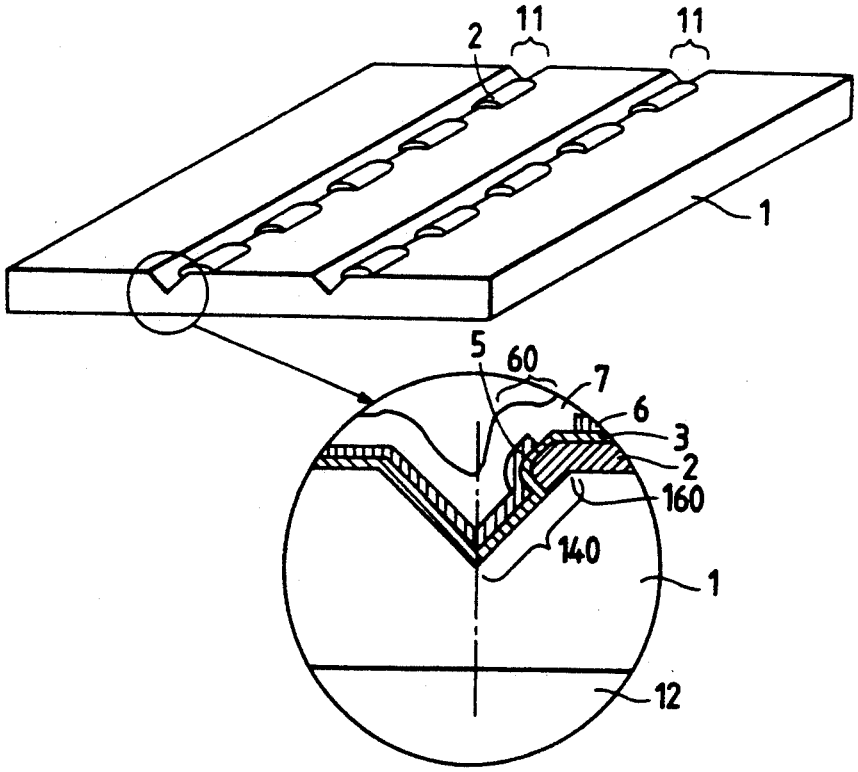

The method of manufacturing the thermal print head according to the present invention will now be described with reference to the accompanying drawings. The substrate may be made of various kinds of material such as alumina, glass, and insulated metals. Referring to FIG. 12, the substrate 1 is grooved 11, and then a glass paste is screen-printed on both sides of a boundary section 160 of the groove 11 so that it confront on the groove 11 faces and burned to form a partially glazed glass symmetric in cross section. Thus, the thermal print head substrate with the partially glazed glass is obtained. Although, as shown in FIG. 13, the partially glazed glass may be formed only on one face of the groove without being arranged symmetrically on both groove 11 faces, the symmetric arrangement allows the manufacturing steps to be simpler, thereby reducing the manufacturing cost. Thus, it is more desirable. The thermal print head substrate thus prepared is subsequently subjected to a thin film deposition process such as a PVD (Physical Vapor Deposition) or a CVD (Chemical Vapor Deposition) and to a conventional photolithographic process to pattern the substrate to form a heating element section 60. Thereafter, a protective layer 7 is arranged and the substrate is cut at a predetermined cutting position 12 to obtain a thermal print head.

As described above, the present invention allows the provision of a thermal print head with a large angle of inclination and a satisfactory current capacity of the common electrode. Accordingly, the problems that printing density is reduced due to voltage drop when many dots are energized concurrently and that printing quality on the rough paper deteriorates have been eliminated.

The present invention further allows the provision of a thermal print head which has a small peak temperature reduction ratio and which is durable and capable of producing high quality printed images with its satisfactory thermal property.

The present invention still further allows the provision of a thermal print head capable of producing high quality printed images with its partially glazed glass surface of smaller radius of curvature being produced stably. The arrangement of a thick film common electrode under the partially glazed glass surface provides the advantage of confining the peak temperature reduction ratio to a small range.

Moreover, the method of manufacturing a thermal print head allows the production of a much larger number of heads a substrate compared with the method of manufacturing a conventional end-face type thermal print head, thereby contributing to a significant reduction in manufacturing cost.

What is claimed is:

1. A method of manufacturing a thermal print head comprising the steps of:

preparing a substrate;

forming a groove on said substrate;

arranging a partially glazed glass symmetrically on said groove;

forming a heating element on said partially glazed glass;

forming a protective film on said substrate through said heating element; and cutting said substrate, along said substrate groove, into a thermal print head.

* * * * *